US006481608B2

(12) United States Patent
Wohlwend et al.

(10) Patent No.: US 6,481,608 B2
(45) Date of Patent: Nov. 19, 2002

(54) POWER FORCE ADJUSTMENT FOR A SETTING TOOL

(75) Inventors: Norbert Wohlwend, Nendeln (LI); Dionys Schalbetter, Haag (CH); Johann Büchel, Sevelen (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/072,717

(22) Filed: Feb. 6, 2002

(65) Prior Publication Data

US 2002/0104867 A1 Aug. 8, 2002

(30) Foreign Application Priority Data

Feb. 6, 2001 (DE) ..... 101 05 142

(51) Int. Cl.[7] ..... B25C 1/08; B25C 1/14

(52) U.S. Cl. ..... 227/9; 227/10; 227/130; 227/142

(58) Field of Search ..... 227/8, 9, 176.1, 227/177.1, 140, 147, 10, 130, 142; 173/13, 18, 47, 48, 141, 10

(56) References Cited

U.S. PATENT DOCUMENTS

| | | | | | |
|---|---|---|---|---|---|
| 4,068,790 | A | * | 1/1978 | Osterle et al. | 227/10 |
| 4,374,567 | A | * | 2/1983 | Combette et al. | 227/10 |
| 5,219,110 | A | * | 6/1993 | Mukoyama | 227/142 |
| 5,560,532 | A | * | 10/1996 | DeFonzo et al. | 227/175.1 |
| 5,579,977 | A | * | 12/1996 | Yang | 227/142 |
| 5,839,638 | A | * | 11/1998 | Ronn | 227/120 |
| 6,186,386 | B1 | * | 2/2001 | Canlas et al. | 227/142 |

* cited by examiner

*Primary Examiner*—Scott A. Smith
*Assistant Examiner*—Brian D. Nash
(74) *Attorney, Agent, or Firm*—Sidley Austin Brown & Wood, LLP

(57) ABSTRACT

A power force adjustment for a setting tool has a housing (1), a mechanism for adjustment of power force using a adjustment wheel (13) rotatable around an axis (12) and a lever (5) pivotally movable around a pivot axis, the lever preventing any movement of the adjustment wheel (13) when in the locked position and when in the release position allows free rotation of the adjustment wheel (13).

6 Claims, 2 Drawing Sheets

POWER FORCE ADJUSTMENT FOR A SETTING TOOL

FIELD OF THE INVENTION

The invention relates to the power force adjustment of a setting tool for driving fastening elements.

BACKGROUND OF THE INVENTION

A wide range of fastening elements are driven from setting tools where the power force is supplied by explosive power or an air-gas mixture. Depending on the application, different setting power forces are required, for example, for fastening elements of different lengths. Different power forces can, for example, be obtained using cartridges of different strengths or with the help of a device that varies the power force output.

The regulation of the power force is accomplished, for example, by using a setting pin that controls the volume of the combustion chamber or the size of the open section of a release channel that connects the combustion chamber or the cartridge holder with the ambient atmosphere. Displacement of the setting pin in the axial direction is done, for example, using a cam disk that converts the rotary movement by the user into a rectilinear movement. With displacement of the setting pin, for example, the overall sectional dimension of the release channel is enlarged or decreased. The overpressure produced in the combustion chamber is vented to the ambient atmosphere through the release channel so that the acceleration of the piston is reduced, consequently reducing the setting power force.

In one setting tool known from the prior art, the adjustment wheel serving to regulate the power force is situated on the side of the setting tool housing. To prevent the wheel from turning on its own when the relevant accelerations and vibrations produced during the setting process act upon the setting tool, the adjustment wheel is biased against the inside wall of the setting tool by the action of a spring arranged between a cam disk and the adjustment wheel. A stud or lug projecting from the inside wall interacts in a form fitting manner with one of a plurality of grooves arranged on the adjustment wheel. Turning the adjustment wheel is only possible if the interlock is overcome by the axial displacement of the adjustment wheel counter to the force of the spring.

SUMMARY OF THE INVENTION

The primary object of the invention is to provide a setting tool with an adjustment wheel for regulating the power force that can be set quickly and securely, that is rotated easily and simply, and can be fixed in a desired position using a locking means. Moreover, the locking means itself and its function must be easily recognizable to the user.

In the setting tool according to the invention the locking means for the adjustment wheel is comprised of a two-armed lever that is arranged on the housing on a pivot and is easily accessible so that the adjustment wheel can be quickly released. Furthermore, the function of the lever is clearly and quickly recognizable.

The pivot axis of the lever extends preferably perpendicular to the axis of the adjustment wheel so that the lever can be pivoted in a plane that is arranged parallel to the adjustment wheel axis and is displaceable about its pivot axis.

To allow the pressure necessary for pivotal displacement of the lever to be applied in a direction running perpendicular to the setting direction, the axis around which the lever can be pivoted, is advantageously rotatable relative to the adjustment wheel.

To achieve automatic reset of the lever into a locking position, as soon as pressure application thereon is released, the lever is appropriately pivoted against the force of a spring out of a locking position and into a releasing position in which the adjustment wheel is freely rotatable.

To assure that accommodation of the spring requires as little space as possible, which ultimately affects the dimensions of the setting tool, it is preferably fashioned as a flat spring.

A particularly simplified form-locking connection is provided preferably by a detent arranged on the first lever arm of the lever, the detent extending into at least one of a plurality of form-fitting recesses arranged circumferentially on the adjustment wheel. The arrangement of the recesses at once provide the advantage that the adjustment wheel can more effectively be rotated by the user without the user's fingers slipping off the adjustment wheel.

Particularly in narrow, hard-to-reach fastening sites it is advantageous if the lever in both its locking position and its releasing position does not protrude beyond the outside surface of the housing. Therefore, the lever is arranged in such a fashion that, in the releasing position, a second lever arm appropriately provided with a contact surface protrudes into a recess in the housing.

BRIEF DESCRIPTION OF THE DRAWING

The invention is more completely explained together with the drawings and using an exemplary embodiment, wherein.

DETAILED DESCRIPTION OF THE INVENTION

Figure 1:
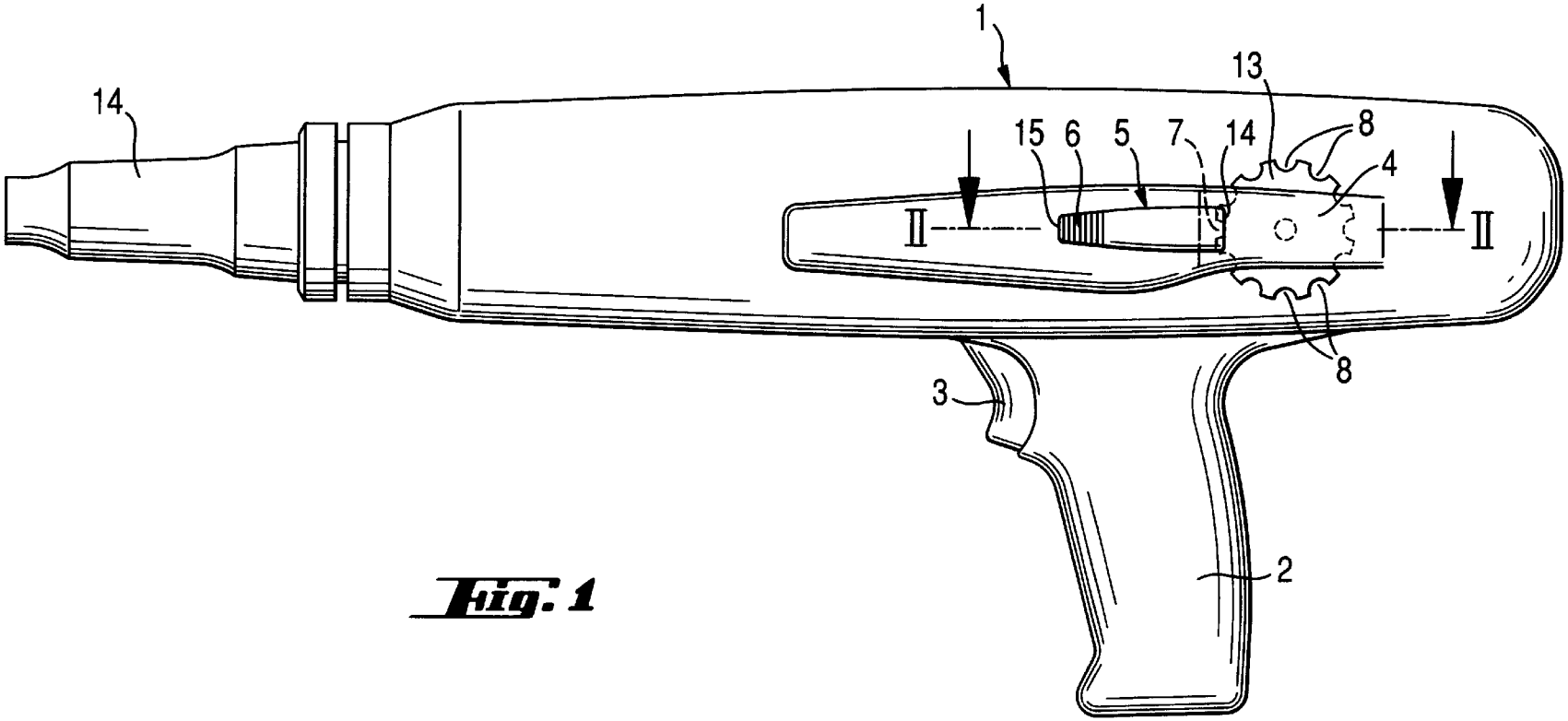
FIG. 1 is a side view of a setting tool embodying to the invention.

The setting tool represented in FIG. 1 is comprised of a housing 1, with a bolt guide at the leading end, a handle 2 projecting laterally from the housing adjacent the opposite end, an actuation switch or trigger 3 in the handle 2, an adjustment wheel 13 associated with a means for regulating power-force, and a locking means that prevents rotation of the adjustment wheel 13. A guide passage (not shown) passes through the setting tool and extends perpendicular to the setting direction through the handle 2 and the housing 1 and serves to receive and guide a strip-shaped magazine in which a plurality of cartridges filled with ignitable explosive powder are arranged.

Figure 2:
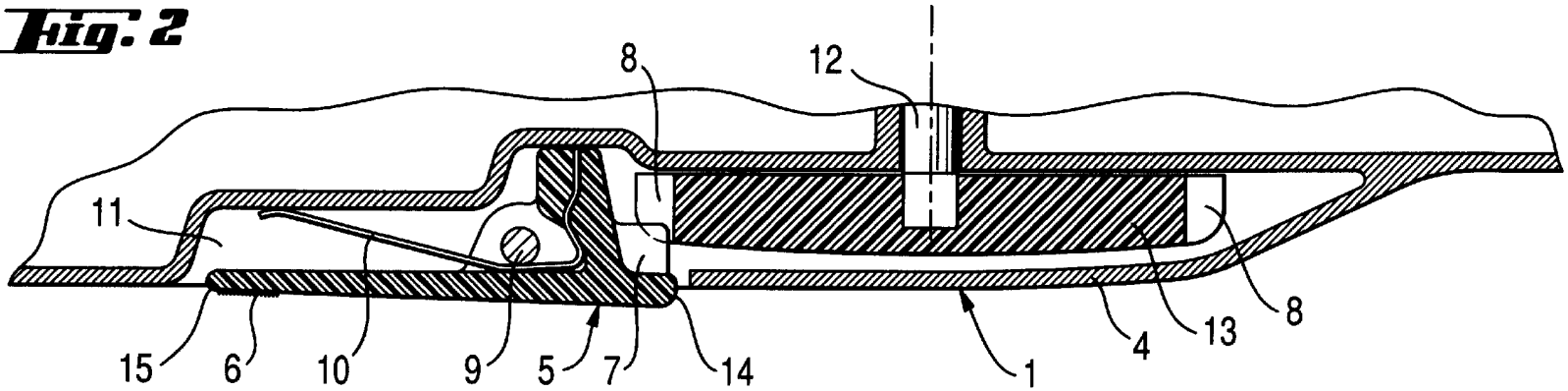
FIG. 2 is an enlarged representation of a section through the setting tool in FIG. 1 along the line II—II; with the locking means situated in a locking position.
Figure 3:
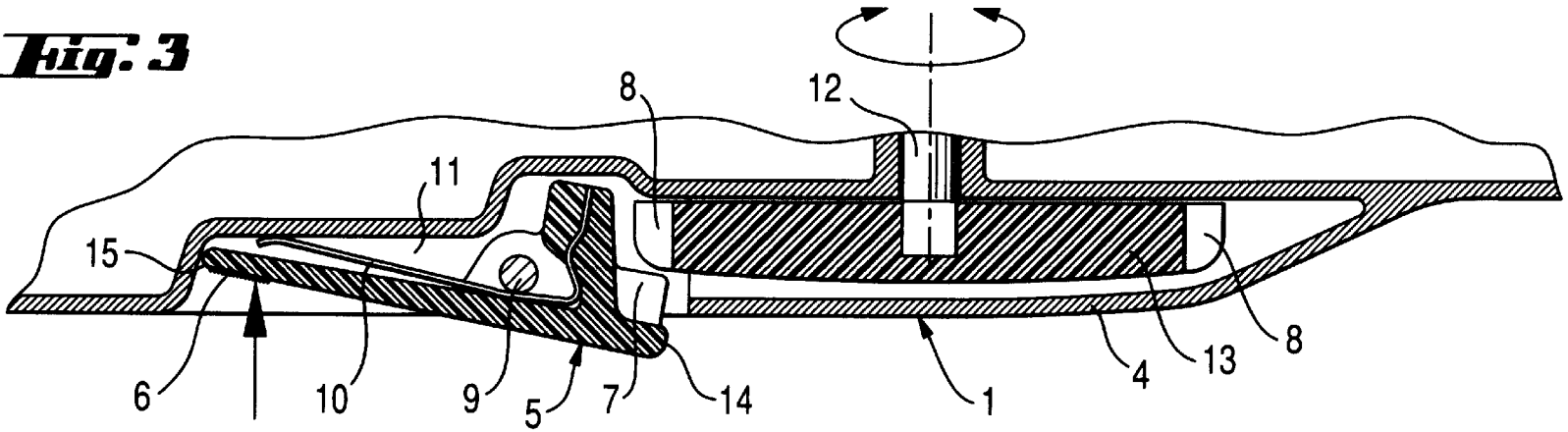
FIG. 3 in an enlarged representation of a section through the setting tool according to FIG. 1 along the line II—II; with the locking means in the releasing position.

The adjustment wheel 13 is overlapped in part by a cover 4 associated with the housing 1 so that only two diametrically opposed circumferentially by extending regions of the adjustment wheel 13 are accessible to the user. On its circumference the adjustment wheel has a plurality of recesses 8. As particularly shown in FIGS. 2 and 3, the locking means is comprised of a pivot lever 5 that is comprised of two rectilinear lever arms 14, 15. A first lever arm 14 has a detent 7 that engages in a form fitting manner into one of the recesses 8 of the adjustment wheel 13 when in the locking position shown in FIG. 2.

A second lever arm 15 is on a side extending away from the first lever arm 14 and is provided with a profiled contact surface 6 intended to prevent slippage from the lever 5 when the lever is being actuated. The lever 5 is at least partially housed in a recess 11 of the housing 1. On the application of pressure on the second lever arm 15, the lever 5 pivots around a pivot axis 9 arranged perpendicular to the axis 12 and into a releasing position. When this is done the second lever arm 15 moves deeper into the recess 11 and thus prestresses a spring 10 formed as a volute or flat spring. In the releasing position the detent 7 of the first lever arm 14 no longer rests in the recess 8 so that the adjustment wheel 13 can rotate freely. In order that the lever 5 can be easily pivoted, the length of the second lever arm 15 exceeds the length of the first lever arm 14.

The adjustment wheel 13 is rotationally connected to an axis 12 that for its part is similarly rotationally associated with a cam disk (not shown). A cam disk translating a rotational movement into a rectilinear movement cooperates with a setting pin, by means of which the volume of a combustion chamber or the dimension of the overall section of a channel is adjusted, the channel providing the connection of the combustion chamber or the cartridge holder with the ambient atmosphere.

What is claimed is:

1. Power force adjustment for a setting tool wherein said setting tool comprises a housing (1) having a setting direction, means on said housing for controlling the power force for driving a fastening element in the setting direction from said housing, said means comprising an adjustment wheel (13) rotatable about an axis (12) extending transversely of the setting direction, said wheel (13) extending partially out of said housing, locking means for preventing rotation of said adjustment wheel (13) said locking means comprises a two armed lever (5) on said housing (1) cooperating with said adjustment wheel (13), said lever (5) being displaceable about in pivot axis (9) on said housing (1) for releasing said adjustment wheel (13) from a locking position into a releasing position.

2. Power force adjustment, as set forth in claim 1, wherein said pivot axis (9) extends perpendicularly to said axis (12) of said adjustment wheel (13).

3. Power force adjustment, as set forth in claim 1, wherein a spring (10) associated with said lever (5) biasing said lever (5) into a locking position, and said lever (5) being displaceable against the force of said spring into the releasing position so that said adjustment wheel is freely rotatable.

4. Power force adjustment, as set forth in claim 3, wherein said spring (10) is a flat spring.

5. Power force adjustment, as set forth in claim 1, wherein said lever (5) has a first lever arm (14) closer to said adjustment wheel (13) and a second lever arm (15) extending from said first lever arm (14) away from said adjustment wheel (13), a detent (7) on said first lever arm engageable in the locking position forms fitting engagement with at least one of a plurality of recesses arranged on the outer circumference of said adjustment wheel (13).

6. Power force adjustment, as set forth in claim 5, wherein said second lever arm (15) has a contact surface (6) and in the releasing position of said lever (5) extends into a recess (1) of said housing (1).

* * * * *